United States Patent [19]

Van Steenburgh, Jr.

[11] 4,366,679

[45] Jan. 4, 1983

[54] EVAPORATOR PLATE FOR ICE CUBE MAKING APPARATUS

[75] Inventor: Leon R. Van Steenburgh, Jr., Denver, Colo.

[73] Assignee: Mile High Equipment Company, Denver, Colo.

[21] Appl. No.: 252,503

[22] Filed: Apr. 8, 1981

[51] Int. Cl.[3] ..... F25C 1/04

[52] U.S. Cl. ..... 62/347; 62/352

[58] Field of Search ..... 62/515, 347, 348, 352, 62/73, 74; 165/171

[56] References Cited

U.S. PATENT DOCUMENTS

| | | | |
|---|---|---|---|
| 2,784,563 | 3/1957 | Baker | 62/352 X |
| 3,045,438 | 7/1962 | Foster | 62/65 |
| 3,220,207 | 11/1965 | Cordes | 62/348 X |
| 3,430,452 | 3/1969 | Dedricks et al. | 62/138 |
| 3,625,023 | 12/1971 | Swanson et al. | 62/348 X |
| 3,913,349 | 10/1975 | Johnson | 62/352 |
| 3,964,270 | 6/1976 | Dwyer | 62/138 |
| 4,154,063 | 5/1979 | Aleksandrow | 62/138 |

*Primary Examiner*—William E. Tapolcai

*Attorney, Agent, or Firm*—George R. Clark; Neil M. Rose; Clifford A. Dean

[57] ABSTRACT

An ice cube making machine having an evaporator plate on which ice is to be made in a vertical plane, the plate having a cube forming lattice structure on one side thereof and an evaporator coil with the inlet and outlet for fluid refrigerant being disposed to freeze water evenly in said lattice structure and to enhance the thawing of the cubes for renewal therefrom.

5 Claims, 8 Drawing Figures

2.
2.
11
11
21
21b
21a
23
23
13c
19
29
17
13a
15
13
13b
33
31
35
27
13
37
29
43
13a
39
19
13c
13b
17
27
33
31
28
35

EVAPORATOR PLATE FOR ICE CUBE MAKING APPARATUS

BACKGROUND OF THE INVENTION

This invention relates generally to ice cube making apparatus and more specifically to an evaporator plate for use in an ice cube making machine.

For the purpose of making cube ice for commercial installations, such as restaurants, bars, motels and the like there are a number of varieties of cube ice machines available on the market. They all include some type of chilled plate or mold in or against which water is delivered for freezing into ice cubes. The chilled member, which supplies the cooling for freezing the water, may be termed an evaporator plate, which conventionally includes refrigerant coils disposed on one side of the plate and on the reverse side some sort of pockets or recesses in which the water is frozen into cubes of ice. In some machines the evaporator plate is disposed horizontally and on some occasions in a vertical position. Whichever disposition is utilized, the evaporator plate must be designed so that water may be delivered to the plate for freezing into cubes and the frozen cubes may thereafter be removed from the plate, or harvested, as such removal is termed.

In order to facilitate harvesting the ice, it is more convenient to position the evaporator plate in a vertical position or a horizontal position with the ice forming molds facing downwardly so that the cubes may be largely harvested by gravity. Examples of ice cube makers having gravity harvesting of the cubes are shown in the U.S. Pats. to Dedricks et al., No. 3,430,452, Johnson, No. 3,913,349, and Dwyer, No. 3,964,270. In the types of machines characterized by the Dedricks et al. patent and the Johnson patent, the evaporator plates are either in a vertical or near vertical position with the cube forming molds being provided by lattice configurations positioned on the evaporator plates on the side remote from the refrigerant coils. Water delivered across the top of the lattice structure runs downwardly across the face of the evaporator plate with portions thereof freezing in the pockets of the lattice as the water trickles across the plate. In the case of the Dedricks et al. patented structure, horizontally extending walls of the lattice are angled downwardly slightly so that the cubes may be harvested by gravity when released from the evaporator plate. Similarly, in the structure disclosed in the Johnson patent, the evaporator plates are tilted downwardly from the vertical so that the horizontal walls of the lattice are tilted downwardly, again, to permit gravity harvesting of the cubes. There are also similar commercial ice machines in which the evaporator plates are positioned vertically but which utilize mechanical harvesting means to disengage the cubes from a lattice work which is not inclined to permit the gravity harvest.

In all these machines utilizing the lattice form molds on generally vertically disposed evaporator plates, the ice making cycle is completed only when a complete slab is formed wherein the pockets in the lattice are full of ice and there are bridging connections between the adjacent rows of cubes to form a continuous slab in which all of the cubes are interconnected. The formation of a continuous slab is important since it facilitates the removal or harvesting of all of the cubes substantially simultaneously. If the cubes were not all connected in a single slab, minor variations in the temperature and the surface texture of the plate or the lattice would result in the cubes being harvested in a random manner with many of the cubes taking longer than average to be disengaged from the evaporator plate and the lattice. Such a random delivery of the cubes would necessitate lengthening the time for the harvesting portion of the cycle and would, therefore, cut down substantially on the output of the machine. Accordingly, one of the main goals in ice machines of this general type is to form a proper slab of ice which is uniform across its face so that it may be harvested to produce maximum output from the machine. If the slab is not uniform in thickness, the bridging portions of ice will be weak in some areas having a tendency to break and thereby retard or prevent the rapid harvesting of all of the ice on the evaporator plate. It should also be noted that if the freezing cycle is extended sufficiently to build up sufficiently strong bridging portions in spite of the uneven freezing across the surface of the slab, the bridging portions in some areas will be very thick. It is well known that an ice machine is operating least efficiently during this terminal portion of the cycle when the water being frozen is insulated from the evaporator plate by a maximum thickness of ice. Therefore, it is important to the efficiency of the ice making machine that the cycle be terminated as soon as possible after the ice has built up over all of the conducting portions of the evaporator plate and its lattice structure.

In considering the refrigeration means associated with the evaporator plate in a typical ice machine, we have noted that the evaporator plate typically includes a coil secured to one side thereof through which the liquid refrigerant is passed. This coil typically takes the form of a copper tube which has a plurality of parallel horizontally disposed legs which traverse the rear face of the evaporator plate and are interconnected by radiused portions of tubing. A refrigerant supply line typically extends from a compressor through a condenser which may be air or water cooled and then through an expansion valve to an input leg at the bottom of the evaporator plate. The liquid refrigerant then traverses the plate through the serpentine coil, passing back and forth through the adjacent horizontal legs in moving to the uppermost leg which is connected to the input of the compressor.

This typical arrangement of the evaporator coil on the plate presents serious drawbacks in the cube ice maker of the types described above. The liquid refrigerant passing through the serpentine coil has various degrees of effectiveness throughout its travel across the plate. When the refrigerant initially enters the evaporator coil, it is characterized by low temperature but has a high velocity which lessens its heat transfer to the plate. By about the midpoint of the serpentine coil, the velocity of the liquid has decreased while the temperature is still low, giving the maximum heat transfer. Thereafter, the liquid warms slightly with there being some gas present toward the output end of the serpentine coil. This diminished effectiveness of the refrigerant as it moves toward the top of the evaporator plate causes the cooling effect to be less which also results in a slower formation of ice at the upper edge of the lattice on the evaporator plate. It should also be noted that the water delivered to the upper edge of the plate is slightly warmer thereby placing a greater load on the refrigerant system at the upper edge of the evaporator plate. This results in slower freezing of the water and thinner bridging members between the ice cubes in the top rows of cubes than is found in other portions of the finished slab of ice. This nonuniformity creates the problems discussed above insofar as harvesting of the ice and efficiency of production are concerned.

When the freezing cycle is completed and harvesting is begun, a solenoid valve in the refrigerant system is actuated, causing hot gas to be delivered to the evaporator coil instead of liquid refrigerant delivered during the freezing cycle. The hot gas quickly raises the temperature of the evaporator plate and the tubing as well as the lattice, causing the slab along with the cubes to be detached from the surfaces on which they were frozen. The harvesting may not take place immediately since there is a thin film of water between the ice and the evaporator plate including the lattice structure, which tends to retain the slab against the evaporator plate as a consequence of the capillary forces involved.

The lattice is provided with drain holes so that as a slab moves slightly away from the evaporator plate, the water causing the capillary forces drains out from between the ice and the evaporator plate. Once the water has been drained, the slab may be harvested quickly and easily either by gravity or other means depending upon the type of machine involved. One of the difficulties involved in this type of harvesting is the fact that the hot gas enters the bottom of the serpentine coil on the evaporator plate causing the greatest melting at the lower edge while the hot gases are relatively cool by the time they reach the outlet on the upper edge of the plate. This differential in gas temperatures results in substantially greater melting of the ice at the bottom than at the top and results in needless wastage of ice prior to the release of the cubes at the top edge of the evaporator plate. In order to obtain maximum efficiency from an ice machine, it is important that a minimum amount of the previously frozen ice be melted during the harvesting portion of the cycle. Ideally the separation of the cubes from the evaporator plate should occur simultaneously across the entire slab to achieve maximum efficiency.

BRIEF DESCRIPTION OF THE INVENTION

The evaporator plate of the present invention utilizes a refrigerant coil which is arranged to deliver the most effective cooling at the top edge of the evaporator plate and also to associate together the portions of the refrigerant coil which are least effective and the portion which is most effective in order to average out the results and provide a reasonably uniform cooling across the entire plate with a minimum amount of change to the refrigerant coil. The refrigerant is introduced at the bottom of the plate and continues upwardly through horizontally disposed legs in the coil until approximately the middle portion wherein the coil extends vertically to connect with an intermediate leg at the top of the evaporator plate and is circulated through adjacent horizontal legs as it moves downwardly to a centrally disposed leg to which the outlet of the coil is connected. This configuration averages high and low temperatures in the coil adjacent the middle of the plate and provides maximum cooling to the top of the evaporator plate where the load, as described above, is the greatest. The resulting uniform slab of ice facilitates harvesting of the cubes as a consequence of the elimination of breakage of the slab in the bridge areas and it also reduces unnecessary melting of the ice which would thereby reduce the efficiency.

During the harvesting portion of the cycle, the hot gas passing through the serpentine coil is distributed more evenly across the face of the evaporator plate so as to promote uniform and rapid release of the ice slab formed on the evaporator plate. In this connection it has been determined that more efficient harvesting of an ice slab may be accomplished by releasing the slab around the edges first and then releasing the slab in the central area. This prevents the slab from cocking in the lattice work which would cause unnecessary melting and possibly prevent the slab from readily detaching itself from the lattice. With the thawing at the center last where the outlet leg of the coil is positioned, the central horizontal strip of the evaporator plate and the lattice will support the slab in an undisplaced or uncocked position whereby the melting caused by the plate and the lattice in the other areas of the slab will be minimized, again, increasing the efficiency of the machine as compared to machines in which the ice slab can cock and augment the melting of the cubes prior to harvesting.

It is contemplated that the improved evaporator plate would be used with a mechanical probe harvesting device which would engage the slab slightly off from the center thereof to quickly and efficiently displace the slab from the lattice as soon as the thawing and drainage of the capillary water had been completed.

Accordingly, it is an object of the present invention to provide an improved ice cube making machine having an evaporator plate adapted to freeze ice uniformly across the face thereof.

It is another object of the present invention to provide an improved ice cube machine having a vertically disposed evaporator plate with a cube forming lattice on one side and an improved form of evaporator coil on the other side thereof.

It is still a further object of the present invention to provide an improved evaporator plate for use in an ice cube machine, such plate having a cube forming lattice on one side thereof and a serpentine refrigerant coil with the input disposed at the bottom thereof and the output connected toward the center thereof and the portion of highest efficiency disposed at the center and the top of the evaporator plate.

A further object of the present invention is to provide an improved evaporator plate which freezes ice uniformly across the face thereof and thaws ice with the application of hot gas along the edges first leaving the center portion the last to be separated from the plate.

DETAILED DESCRIPTION OF THE INVENTION

Figures 1, 2:
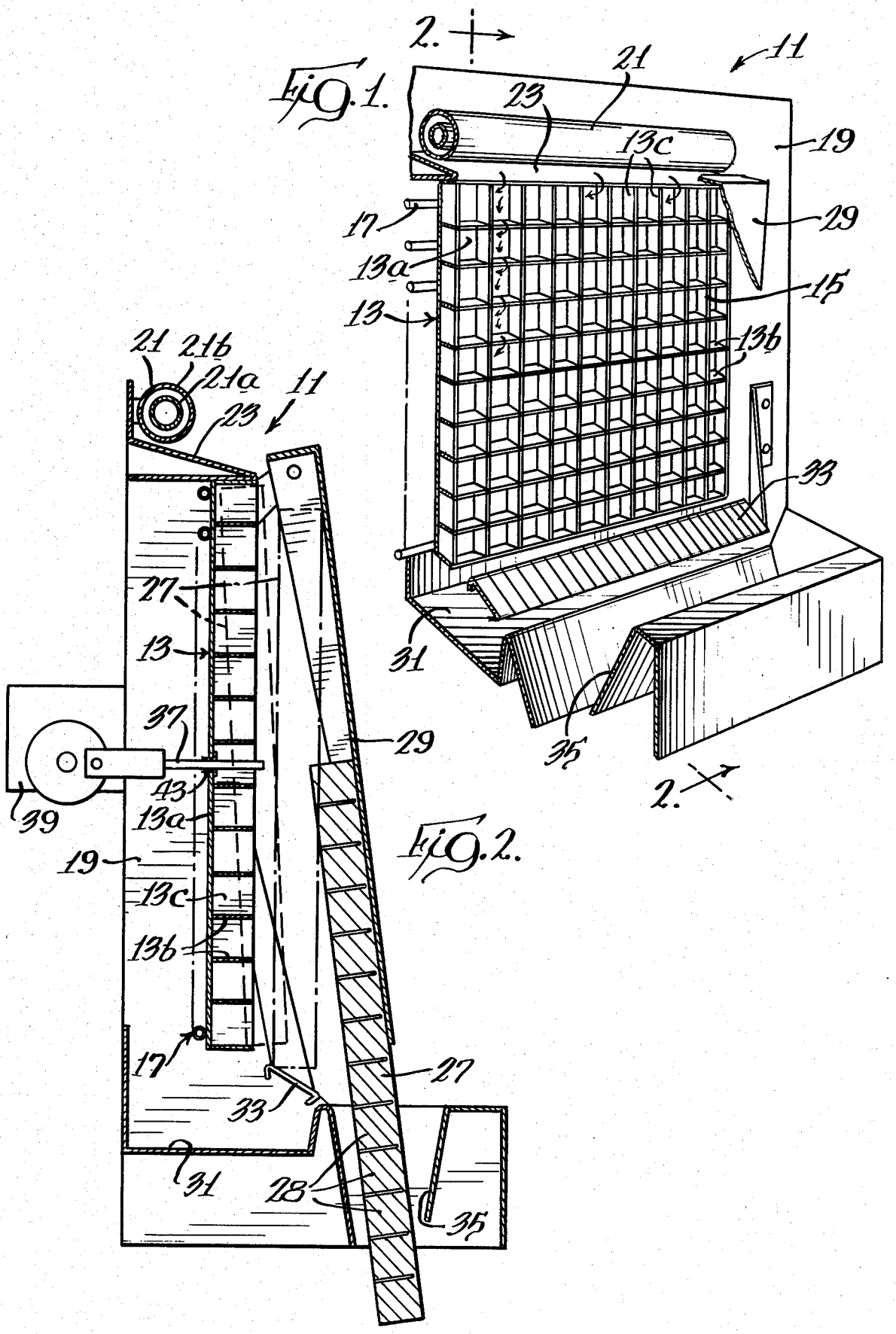
FIG. 1 is a cutaway perspective view of an ice cube making machine embodying my invention.
FIG. 2 is a sectional view taken substantially on line 2—2 of FIG. 1.
Figure 3:
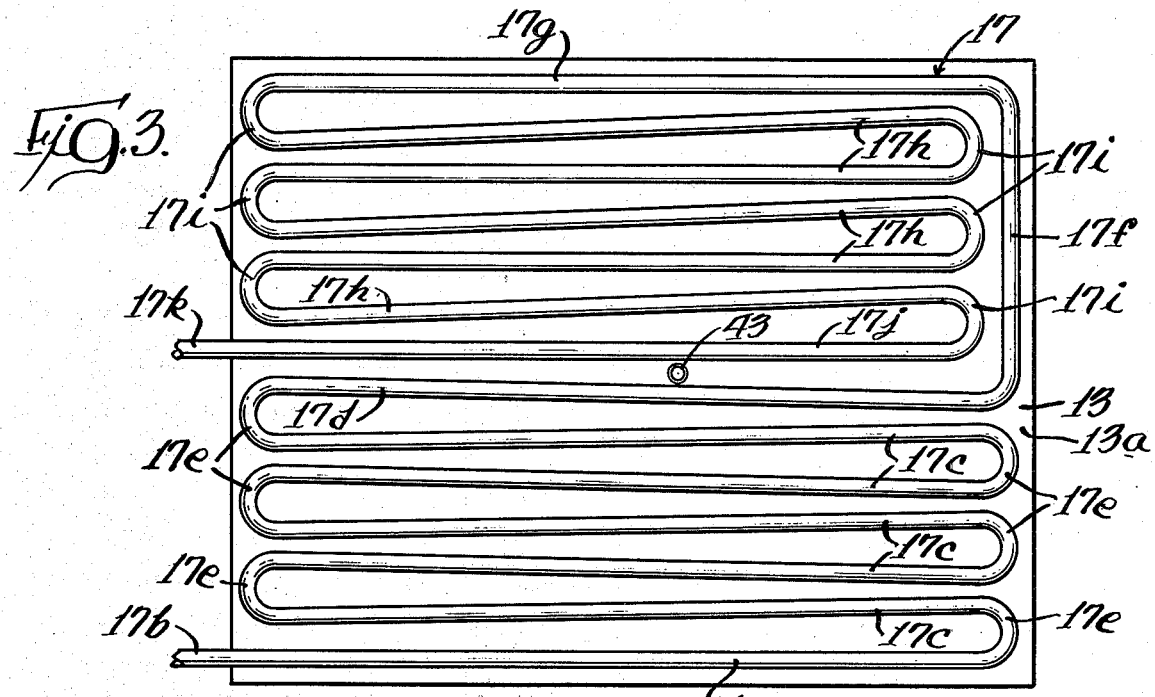
FIG. 3 is a rear view of an evaporator plate embodying my invention.

Referring to the drawings, there is shown an ice cube making apparatus or machine designated generally by reference numeral 11. The showing of the machine 11 is somewhat schematic since my invention resides primarily in the evaporator plate while the associated portions of the machine, including the water delivery means, as well as the refrigerant system are well-known to those skilled in the art. For a more complete description of the ice cube making apparatus and its associated refrigerant system and electrical controls, reference may be made to my copending application filed contemporaneously with this application. The apparatus 11 includes an evaporator plate 13 which has a lattice structure 15 secured to the front side thereof and a serpentine refrigerant coil 17 secured to the rear face thereof. The evaporator plate is formed of a copper base member or plate 13*a* to which horizontal walls 13*b* and the vertical wall 13*c* are assembled by soldering to achieve good heat transfer connections between the base plate 13*a* and the walls 13*b* and 13*c*.

Figure 4:
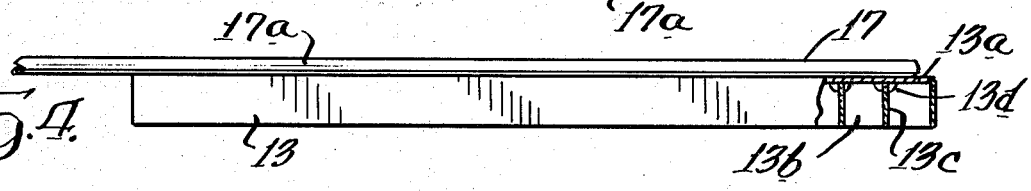
FIG. 4 is a bottom view of the evaporator plate of FIG. 3.
Figure 5:
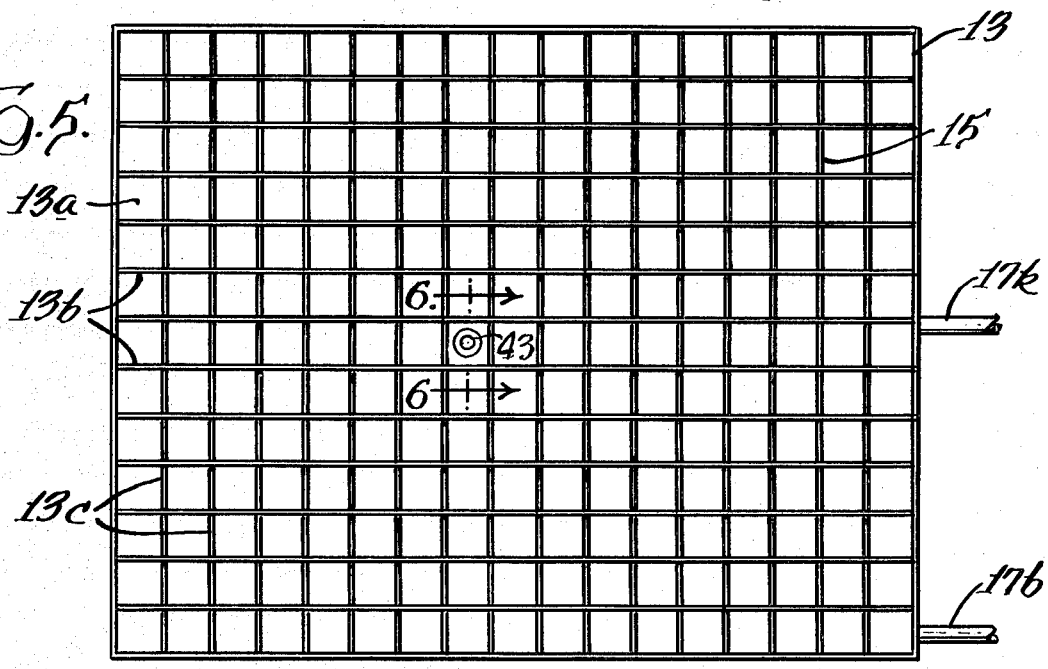
FIG. 5 is a front view of the evaporator plate of FIG. 3.
Figure 6:
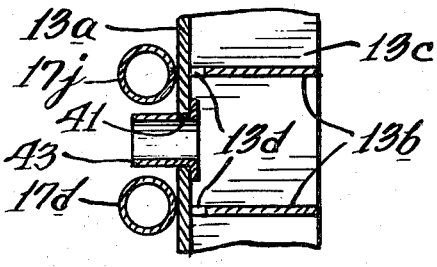
FIG. 6 is an enlarged fragmentary sectional view of the evaporator plate taken substantially along line 6—6 of FIG. 5.

As is well-known in the art, openings are provided in the horizontal walls 13*b* and the vertical walls 13*c* adjacent the base plate 13*a* to permit the water to drain from between the ice and the evaporator plate during the harvesting portion of the cycle. In FIGS. 4 and 6, openings 13*d* in the walls 13*b* are shown. It should be understood that there are corresponding openings or slots in walls 13*b* in the area of the openings 13*d* so that the capillary layer of water may pass between the individual cube compartments and downwardly along the face of the plate 13*a* during harvesting.

The horizontal walls 13*b*, the vertical walls 13*c*, and the base member or plate 13*a* form a plurality of sidewardly opening pockets within which water is frozen to form ice cubes. The evaporator plate 13 is supported by a frame 19, which also supports the other major components of the ice cube making apparatus 11.

Immediately above the evaporator plate 13, the frame 19 supports a water delivery tube 21, which extends the entire width of the evaporator plate. The water delivery tube 21 comprises concentric tubes 21*a* and 21*b* which are designed to deliver the water evenly over the length of an angled plate 23 from which the water runs downwardly onto the lattice 15 of the evaporator plate 13. The internal tube 21*a* of the water delivery tube 21 is connected to a source of water and has upwardly facing openings spaced along the length of the tube to supply water to the interior of the larger tube 21*b*. The tube 21*b*, in turn, is provided with a plurality of aligned spaced openings on its lowermost portion which deliver the water across the length of the angled plate 23. The concentric tubes 21*a* and 21*b* serve to eliminate any pressure variations over the length of the tube and provide equal flow from the openings along the length of the water delivery tube 21.

As the water flows by gravity downwardly across the evaporator plate 13, the capillary action of the water with respect to the horizontal walls 13*b* permits the water to follow the walls of the lattice structure 15 thereby wetting the entire surface of the evaporator plate and its associated lattice structure 15. The cooling effect provided by the low pressure liquid passing through the refrigerant coil 17 chills the base plate 13*a* and the associated walls 13*b* and 13*c* of the lattice structure 15 causing the water passing downwardly over the evaporator plate 13 to freeze.

Because of the high thermal conductivity of the base plate 13*a* in the walls 13*b* and 13*c*, the freezing of the cubes takes place on all of the walls of the pockets formed by the lattice 15 ultimately resulting in complete ice cubes being formed. As the freezing of the cubes is completed, as may best be seen in FIG. 7, bridging sections 25 are formed between the adjacent cubes thereby creating a slab 27 in which the individual cubes 28 are connected by the bridging sections 25.

One of the most important aspects of an ice machine insofar as efficiency is concerned is the manner in which the ice cubes are removed from the cube forming molds or harvested after they have been frozen. A considerable amount of energy and time must be expended to freeze cubes of a particular size and weight. In order to detach the cubes from the molds in which they are formed it is, therefore, necessary to supply a considerable amount of mechanical force or to thaw the ice along the surfaces of the forming molds so the ice may be displaced from the molds with the use of a minimal amount of power. However, the melting of the ice in connection with the harvesting or cube removal represents an entirely unproductive portion of the cycle which tends to subtract from the efficiency which may have been achieved during the freezing portion of the cycle. Accordingly, it is desirable to minimize the melting of the cubes during the harvesting cycle. One of the problems associated with gravity harvesting of ice is that it is often necessary to melt a greater percentage of the cubes than would be necessary if a mechanical harvesting were used to detach the cubes from the ice forming mold. In addition, to obtain harvesting in an optimum period of time it is necessary to harvest the entire unbroken slab of ice with a minimum of cocking or displacement of the slab prior to its freeing itself from the evaporator plate.

Referring to FIG. 2, there is shown a slab of ice 27 in the various positions through which it moves during the harvesting process. The ice cube making apparatus 11 includes a pivotal cover member 29 which is pivotally connected to the frame 19 for swinging movement about its upper edge. In its normal position during the freezing portion of the cycle, the cover 29 extends substantially vertically and deflects any water which might splash from the front of the evaporator plate 13. Thus, all of the water passing across the evaporator plate 13 drains into a reservoir 31 in the event that it is not frozen as it traverses the lattice 15 on the evaporator plate 13. The water in the reservoir 31 is then recirculated through the water delivery tube 21 from which it passes again across the evaporator plate 13.

At the lower edge of the evaporator plate 13 there is provided an ice deflection grating 33 which comprises a plurality of ribs through which water must pass into the reservoir 31 but which are sufficiently close together to prevent ice cubes from entering the reservoir 31. Any ice cubes impinging on the angled grating 33 are deflected laterally into an opening 35 which communicates with a cube storage bin.

As illustrated in FIG. 2 by the initial two dotted line showings of the slab of ice cubes 27, the slab is initially displaced with the bottom moving outwardly in response to force exerted by a harvesting plunger 37. At a predetermined point in the freezing cycle, the flow of water across the evaporator plate is terminated and the path of the refrigerant is changed by opening a solenoid in the output of the compressor so that hot gas is delivered to the refrigerant coil 13 rather than the low pressure liquid which produces the cooling in the evaporator plate. At the same time, the harvesting plunger 37 is activated by a motor 39 which reciprocates the plunger 37 through an opening 41 in the base plate 13*a* to engage a point in the slab 27 which is displaced horizontally a slight distance from the geometric center of the slab 27. The plunger 37 is guided by a bushing 43 which is received in the opening 41 as best shown in FIG. 6. The details of the harvesting plunger 37 and the manner in which it operates to displace the slab 27 from the evaporator 13 are described in greater detail in my copending application filed concurrently herewith. It is noted, however, that a clutch mechanism is associated between the harvesting motor 39 and the harvesting plunger 37 in order to obtain a relatively constant pressure against the slab 27.

As the slab 27 moves free of the lattice 15, it falls downwardly striking the grating 33, as shown in FIG. 2. The cover 29 pivots outwardly at the bottom when engaged by the slab 27 and permits the slab 27 to fall through the opening 35 into the storage bin. Thus, the movement of the slab 27 as it moves from the evaporator plate 13 into the storage bin is guided by the grating 33 and the cover 29, the upper end of which restrains the outward movement of slab 27, as illustrated in FIG. 2.

Referring now to FIGS. 3 to 6, it is noted that the evaporator plate 13 is of generally rectangular configuration being substantially longer than it is wide. The base plate 13*a* supports on its rear surface the refrigerant coil 17 which is uniquely arranged to provide the optimum results in the freezing portion of the cycle as well as optimum results in the harvesting portion of the cycle. It has been conventional in the past to secure refrigerant coils to evaporator plates in a manner which facilitates manufacture accepting the proposition that the cooling effect delivered over the length of the coil will be substantially constant per unit of length. While this assumption is not correct, as will be explained in further detail below, it is also noted that the load on the evaporator plate is in no way constant thereby making it desirable to provide increased cooling to certain portions of the evaporator plate during the freezing cycle and to provide different patterns of thawing during the harvesting portion of the cycle.

To accomplish these objectives I have provided an evaporator plate 13 having the refrigerant coil 17 disposed with an input leg 17*a* at the bottom edge of the base plate 13*a* with the coil 17 having an input end 17*b*. Extending in spaced parallel relation to the input leg 12*a* are intermediate legs 17*c* and a centrally disposed leg 17*d*. The legs 17*a*, 17*c* and 17*d* are all connected by 180° turn connections 17*e*. The end of the leg 17*d*, most remote from the input 17*b*, is connected by vertical leg 17*f*, which extends to the top edge of the base plate 13*a* where it interconnects with a horizontally extending leg 17*g* on the upper edge of the base plate 13*a*. Disposed below the leg 17*g* and in spaced parallel relation thereto are further legs 17*h* which are all interconnected by 180° turn 17*i* to the output leg 17*j* which terminates in an output end 17*k*. The low pressure liquid refrigerant is introduced into the coil 17 at 17*b* from where it passes through the continuous coil 17 to the outlet 17*k*. By the time the low pressure liquid has arrived at the output leg 17*j* it has lost most of its cooling capacity and become a superheated gas which is returned to the compressor in the refrigeration system.

To understand the basic reasons behind the arrangement or disposition of the various legs of the refrigerant coil 17, the manner in which the low pressure liquid passes through the coil 17 and the manner in which the heat is absorbed thereby should be understood. In the input leg 17*a*, the low pressure liquid is at its minimum temperature, however, because of the higher velocity in this portion of the coil 17, it is less effective than when the velocity decreases to some extent. Therefore, the maximum effectiveness of the low pressure liquid is achieved in legs 17*d* and 17*g* when the temperature is still reasonably low and the velocity is considerably decreased from that existing in the input leg 17*a*. As the temperature of the low pressure liquid continues to increase in the legs 17*h*, the refrigerant ultimately reaches a stage where it is a superheated gas as it enters the output leg 17*j*. Because of these relative efficiencies, the cooling effect of the legs 17*j* and 17*d* tend to equalize to produce a relatively uniform cooling effect across the face of the base plate 13*a*.

Although it might seem that the high efficiency in the leg 17*g* would produce more cooling or ice freezing capacity in this portion of the evaporator plate, it should be noted that the upper edge of the evaporator plate is under a substantially greater load since the water is initially delivered at the upper edge of the evaporator plate 13 and any cooling of the water to the freezing temperature must load that portion of the evaporator plate more than any other portion thereof.

The construction of the evaporator plate is conventional insofar as the use of copper elements which are soldered together is concerned. The base plate 13*a* may have its edges formed up to provide the outermost walls 13*b* and 13*c* of the lattice 15 as is shown in part by the sectioned area in FIG. 4. The horizontal walls 13*b* of the lattice 15 are notched at 13*d*, as shown in FIGS. 4 and 6 and such notches are located at slots in the vertical walls 13*c* to provide drain openings through which the melted ice may drain to release the capillary forces which would otherwise retain the slab 27 during harvesting.

Figure 7:
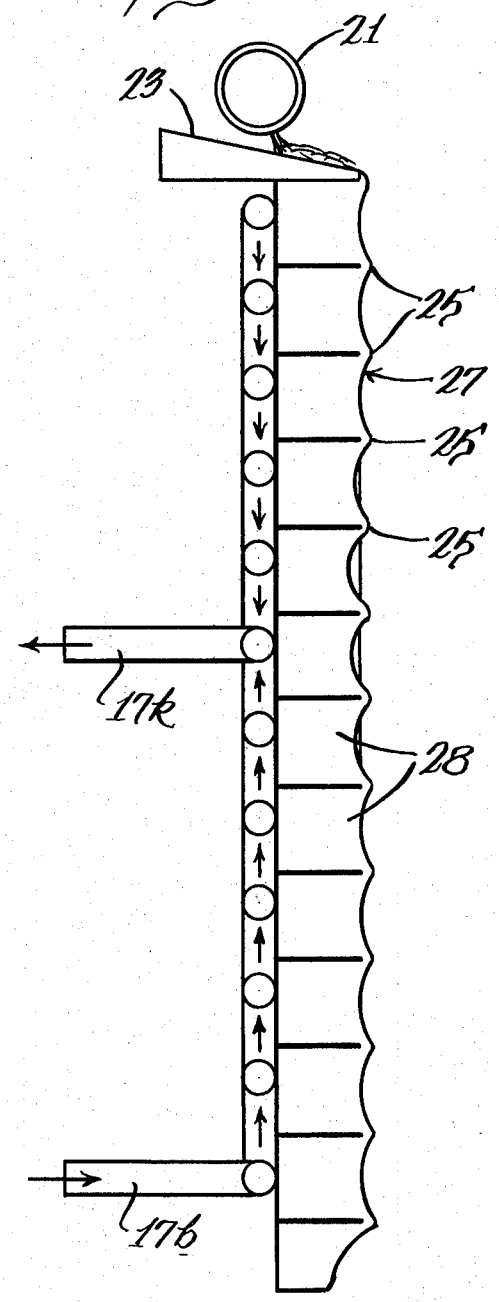
FIG. 7 is a somewhat schematic vertical sectional view of the evaporator plate showing the manner in which ice would be formed thereon.
Figure 8:
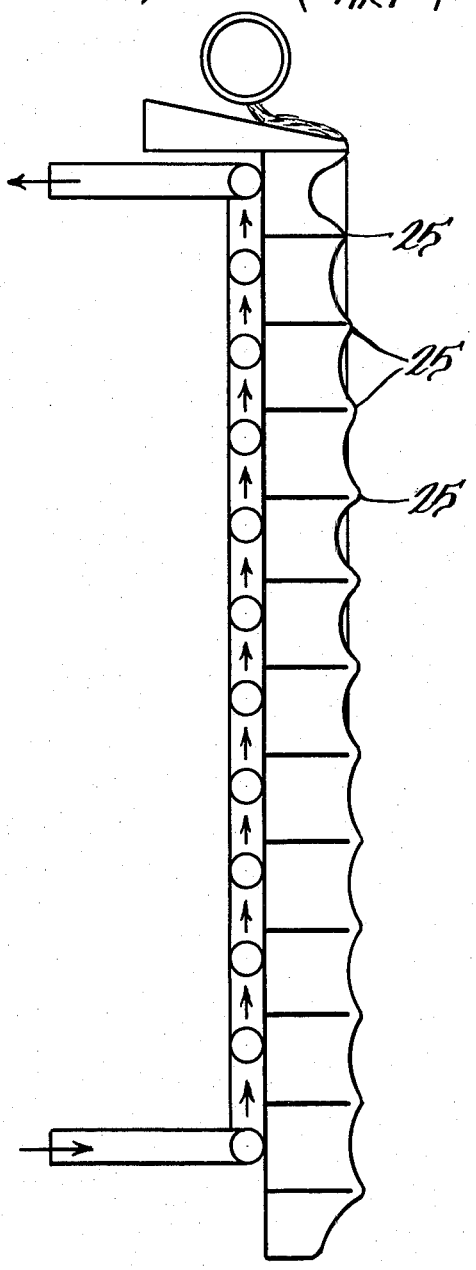
Fig. 8. (PRIOR ART)
FIG. 8 is similar to FIG. 7 but is illustrative of the prior art showing the manner in which ice freezes on an evaporator plate having the refrigerant coil disposed in a conventional manner.

Referring to FIGS. 7 and 8 of the drawings, FIG. 7 is illustrative of the actual cube freezing patterns achieved with the refrigerant coil distribution described above while FIG. 8 shows the actual freezing results achieved in a conventional cuber now on the market in which the coils are arranged in the conventional manner with the input at the bottom and output at the top. The pattern embodied in my invention clearly compensates for the increased load at the upper portion of the evaporator plate and produces relatively uniform freezing throughout the area of the evaporator plate with uniform bridging sections 25 provided throughout. As is evident in FIG. 8, in the prior art, the bridging sections 25 between the upper two rows of cubes 28 are so thin as to cause a tendency for the slab 27 to break during harvesting.

With respect to the harvesting portion of the cycle, it has been found that the coil distribution described above provides further significant advantages. In the prior art, the major portion of the heating provided by the hot gas cycled to the evaporator coil caused extreme melting at one edge of the slab with the far edge being the last to be released. This resulted in cocking or displacement of the slab, severe melting of the cubes in the lower rows and often caused breakage of the bridge sections resulting in incomplete or extended harvesting periods. In my arrangement the hot gas is effective in releasing the slab 27 at the upper and lower edges of the evaporator plate while the central portion disposed adjacent the leg 17*j* tends to be the last to separate from the evaporator plate. It has been found that the slab 27, under these conditions, will have less tendency to cock or displace until such time as final thawing along the central horizontal portion of the evaporator plate has occurred. Without such cooling and displacement, the thawing elsewhere on the slab is minimized being limited to a relatively thin layer of ice which is merely sufficient to detach the slab from the adjacent portions of the evaporator plate. Thus, the slab may be harvested in a minimum period of time with a minimum amount of melting in the individual cubes. This arrangement is particularly advantageous in a combination in which the harvesting means comprises a probe which engages the slab toward the geometric center where the separation between the ice and the evaporator plate is the last to occur. In such a situation, the harvesting probe has no tendency to break the slab 27 or to cock it prior to its being ready to be harvested.

While there has been shown and described a preferred embodiment of the present invention, it will be apparent to those skilled in the art that various changes and modifications may be made without departing from the invention in its broader aspects and it is, therefore, contemplated in the appended claims to cover all such changes and modifications that fall within the true spirit and scope of the present invention.

What is claimed as new and desired to be secured by Letters Patent of the United States is:

1. An evaporator plate for a cube ice making machine comprising a flat rectangular base member having a refrigerant coil in good heat transfer relation to one side thereof and a lattice structure providing ice cube molds on the other side thereof, said coil being formed in a serpentine configuration with a plurality of straight legs disposed in parallel relation with interconnecting radiused portions, said coil being continuous and having one of said legs formed with an input end to receive a low pressure liquid refrigerant and another of said legs formed with an output end from which a super-heated gas/refrigerant is discharged, said one leg extending the length of one edge of said base member and said another leg being disposed extending across the middle portion of said base member, the legs of said coil intermediate the ends of said coil being disposed adjacent to said another leg and at the edge of said base member opposite to said one edge, means for delivering hot gas to said coil for harvesting ice formed on said lattice structure, said hot gas being fed to said coil at said input end and removed at said output end whereby a slab of ice formed on said plate will be melted from said lattice structure at the upper and lower edges prior to melting adjacent said another leg, mechanical means for harvesting said slab of ice including a reciprocable probe mounted on one side of said base member to engage said slab of ice and displace it from said lattice structure.

2. The evaporator plate of claim 1 wherein said coil is disposed with the first half of said coil on one half of said base member with said refrigerant moving through said straight legs toward the middle of said base member and the second half of said coil disposed on the other half of said base member with said refrigerant moving from the opposite toward the middle.

3. The evaporator plate of claim 1 wherein said opening is positioned along said another leg whereby said probe engages said slab in the area which is the last to be melted from said lattice during harvesting.

4. An evaporator plate for an ice cube making machine comprising a flat plate member having a refrigerant coil secured in good heat transfer relation to one side thereof and a cube forming structure on the other side thereof, said coil having an input end to receive low pressure liquid and an output end from which a superheated gas/refrigerant is discharged, said coil being disposed with the output end positioned adjacent the middle portion of the coil whereby the cooling effect on said plate is relatively uniform and the cubes formed in said lattice structure are substantially equal in size, the input end of said coil extending along one edge of said plate member and an intermediate portion of said coil extending along an opposite edge of said plate member remote from said one edge, means for mounting said plate member in a vertical position to form ice cubes in a slab disposed in a vertical plane, means for delivering hot gas to said coil for harvesting said slab of ice from said plate with said gas entering said input end and exiting said coil from said output end, said gas melting said slab from said plate on the lower and upper portions first and along the horizontal area extending across the middle of said plate relatively later, whereby melting of said slab of ice is minimized during harvesting, mechanical means for displacing said slab of ice with respect to said evaporator plate, said mechanical means comprising a probe mounted for reciprocable movement through an opening formed in said plate member to engage and force said slab of ice away from said plate member.

5. The combination of claim 4 wherein said opening in said plate member is disposed near the geometric center of said plate member in said horizontal area.

* * * * *